US006637633B1

(12) United States Patent
Eberle

(10) Patent No.: US 6,637,633 B1
(45) Date of Patent: Oct. 28, 2003

(54) EXPANDABLE BACKPACK

(76) Inventor: Glen Richard Eberle, 2410 Hillway Dr., Boise, ID (US) 83702

( * ) Notice: Subject to any disclaimer, the term of this patent is extended or adjusted under 35 U.S.C. 154(b) by 0 days.

(21) Appl. No.: 10/355,494

(22) Filed: Jan. 31, 2003

(51) Int. Cl.[7] ..... A45F 3/04

(52) U.S. Cl. ..... 224/582; 190/103; 190/108; 190/111; 224/653

(58) Field of Search ..... 224/582, 262, 224/637, 653, 652; 190/103, 108, 111; 383/38, 40

(56) References Cited

U.S. PATENT DOCUMENTS 3,061,057 A * 10/1962 Miller ..... 190/111
3,122,225 A * 2/1964 Ward ..... 190/108
4,436,189 A * 3/1984 Baum ..... 190/108
4,966,260 A * 10/1990 Young ..... 383/38
5,526,907 A * 6/1996 Trawick et al. ..... 190/111
5,609,278 A * 3/1997 Fresco ..... 224/582
5,881,708 A * 3/1999 Kliot ..... 224/653
6,161,665 A * 12/2000 Hoover ..... 190/103
6,408,997 B1 * 6/2002 Chen ..... 190/103

* cited by examiner

*Primary Examiner*—Gary E. Elkins

(57) ABSTRACT

A backpack is provided with a mechanism whereby it can be used in a compact form for carriage of smaller loads or in an expanded form to carry larger loads. In its initial compact form, the backpack's cargo space is divided into two separate compartments which are fixedly attached along their outer vertical seams to the outer edges of the backpack's main panel, and are releasably attached to each other along a central vertical seam by means of a zipper or similar such fastening system. When this said fastening system is released, the primary storage compartments hinge and rotate outwardly, exposing a space that is made available for additional storage. A collapsible supplemental storage compartment is sewn or otherwise attached into this space in such a way that it can be opened and expanded when the afore-mentioned primary storage containers are outwardly deployed. The backpack is fitted with two shoulder carrying straps, and in a preferred embodiment would be fitted with a waist belt.

9 Claims, 3 Drawing Sheets

EXPANDABLE BACKPACK

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The present invention relates to backpacks. In particular, the present invention relates to a backpack for use in holding and transporting clothing, miscellaneous equipment, and various gear for outdoor recreation or other activity wherein a need exists for a device which can be used comfortably to haul a range of lesser or greater and varying loads. The use of backpacks is known and widely established. An example of a "standard" backpack is disclosed in U.S. Pat. No. 4,085,873 to Schweitzer. The variety and extent of backpacks extend from small and lightweight daypacks such as the one disclosed in U.S. Pat. No. 5,573,166 to Leja, to larger and heavier duty backpacks such as that disclosed in U.S. Pat. No. 6,179,188 to Gleason. While there are many exceptional and useful backpacks in the prior art, it is in general a fact that they are fairly uniform in their individual purposes. For example, it wouldn't be practical to use a small daypack to haul a tent, food, sleeping bag, and related gear on a camping trip, just as it is impractical to use a large and bulky expeditionary backpack for a picnic outing. Yet there are activities in which it is desirable to have a single backpack, which is generally compact, but which has the built-in potential to carry a large load of cargo. In the example of the activity of game hunting, there is a common desire to carry a small and compact daypack for a day's outing in order to facilitate quiet and sleek movement through the woods, as well as to minimize the weight being carried. Once game is acquired, however, a small daypack is not typically suited to the carriage of quantities of meat. Where large game is involved, a hunter will often make a first return trip with a light load to the base vehicle or camp, and then will go back with a larger freight frame or large backpack to carry the bulk of the meat out. In an ideal situation, the hunter would have a backpack that was versatile enough to be carried in a compact form for the active hunting portion of the outing, but then could be expanded or enlarged to carry a good portion of meat out on the first return to the camp.

There are diverse examples in the prior art of backpacks which are devised for the carriage of meat, and others that alter configuration or load volume in some fashion. U.S. Pat. No. 6,135,333 to Tucker, et al. discloses a meat carrying backpack, but it can be seen that it doesn't fulfill the need of a simple daypack for hunting. As disclosed in U.S. Pat. No. 5,490,619 to Boyar, the prior art contains examples of backpacks which are devised to be transformed into existence from out of another form, in this case a purse, but this clearly wouldn't be suitable for the purpose described herein. In U.S. Pat. No. 6,053,382 to Wyant, an expansion gusset is disclosed, which is an example of a means of expanding the volumetric carrying capacity of a specific compartment within a backpack. In this case, however, the change in dimension that is affected is not significant enough to be of use to a hunter faced with transporting large game.

Other designs exist which comprise efforts to have a backpack with a flexible load carrying volume. Some are fitted with laced drawstrings or adjustable straps which can compress the cargo space of a pack into its most diminished form. These are excellent in their place, and some may be of use to the hunter, but nonetheless it is generally true that these backpacks do not significantly alter their form, and do not significantly have the capacity to increase their volume. If they are large enough to be of use in hauling meat, they typically do not compress sufficiently to have the look, feel, and compact shape of a daypack.

While backpacks similar to those in the prior art have somewhat fulfilled the transportation and storage requirements of outdoorsmen to date, there exists a need to have backpacks which have better and more convenient deployable additional storage capacity, and offer a greater range of versatility than prior art backpacks. In particular, with a greater and more widely prevalent emphasis on adventure, personal fitness, and personal mobility, many hunters and outdoorsmen are traveling great distances on their feet. In the example of a hunter, there is an incumbent need to make the first return trip from a successful downing of game useful in terms of hauling as much meat as possible from a potentially remote location. It is submitted that the present invention substantially meets these needs.

BRIEF SUMMARY OF THE INVENTION

The backpack of the present invention is devised such that it can be used in a smaller and more compact form, or expanded into a form with greater volume and load capacity. In the specific example of hunting, a user will depart for a day's outing with the basic necessities for the compass of the outing stored in the primary storage compartments of said backpack, and when subsequently game is acquired the backpack can be deployed into its expanded form, wherein it retains full use of the basic storage in the aforementioned primary compartments, and has the additional storage capacity of a newly exposed supplemental storage compartment for the hauling of meat. In an alternative example, the pack can be used in its expanded form to travel with a full complement of camping or traveling gear, which can be subsequently downloaded, thereby allowing the pack to be transformed into its compacted form for use in shorter side-outings.

More particularly, the backpack of the present invention includes a releasable vertical division between two primary storage compartments that, when released, allows the two primary storage compartments to pivot and rotate outwardly about the axis of their attachment to the main panel of the backpack, in thus doing exposing a collapsible supplemental storage compartment which can then be expanded and utilized. The backpack is fully functional and convenient for use in either its compacted or expanded embodiments. In particular, the central dorsal releasable attachment is generally kept in the closed position, thereby keeping the backpack in its compacted form, but when released permits the backpack to be expanded into its larger form. In a preferred embodiment, the supplemental storage compartment is constructed of a heavy duty, lightweight nylon or similar fabric, so that when it is folded it becomes nearly flat, and is of minimal thickness, thereby relieving the backpack of any undue bulk when it is in its compacted form. Preferably, the supplemental storage compartment is fixedly attached to the front portion of the main panel of said backpack, as well as to the inward edge of the back panel of said primary storage compartments, adjacent to and inward from the releasable mechanism, thereby forming an integral unit when the backpack is utilized in its expanded form. Alternatively, the supplemental storage compartment may be removably attached to the aforesaid portions of the main panel and primary storage compartments, thereby permitting use of the backpack without the supplemental storage compartment or with a different load attached in its place, and it can be seen that this does not substantially alter the scope of this invention.

The expandable backpack according to the present invention substantially departs from the conventional concepts and designs of the prior art, and in so doing provides an apparatus which functions well as a small daypack of the prior art, but which can readily be converted into a backpack with greatly increased volume and carrying capacity. There exists a need to move about unencumbered while carrying a backpack of lesser size and volume, but which can be readily transformed into a more voluminous form. In this regard, the present invention substantially fulfils this need.

DETAILED DESCRIPTION OF THE INVENTION

Figure 1:
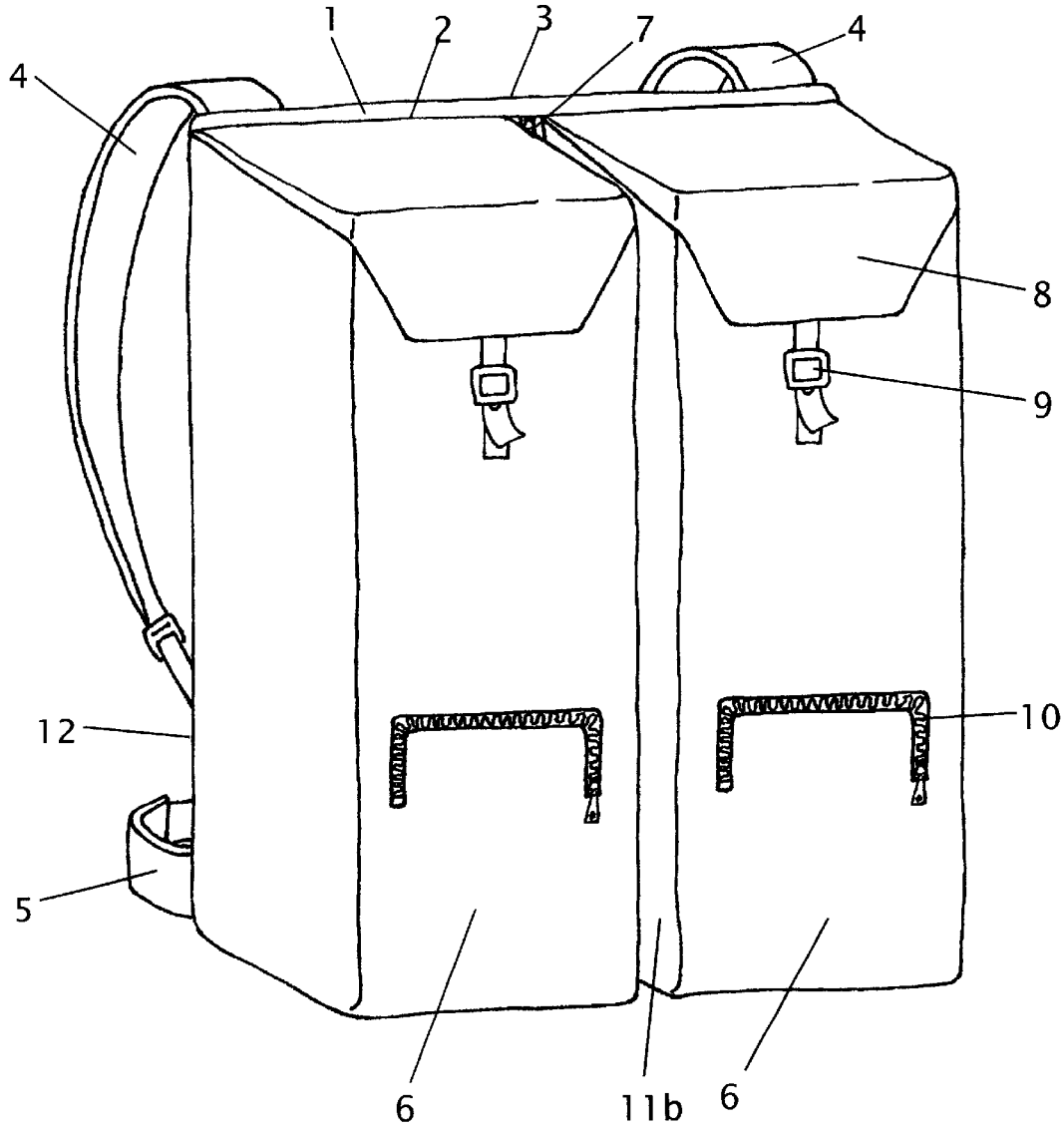
FIG. 1 is an elevated left front quartering view of the invention, showing it in its compact form.
Figure 2:
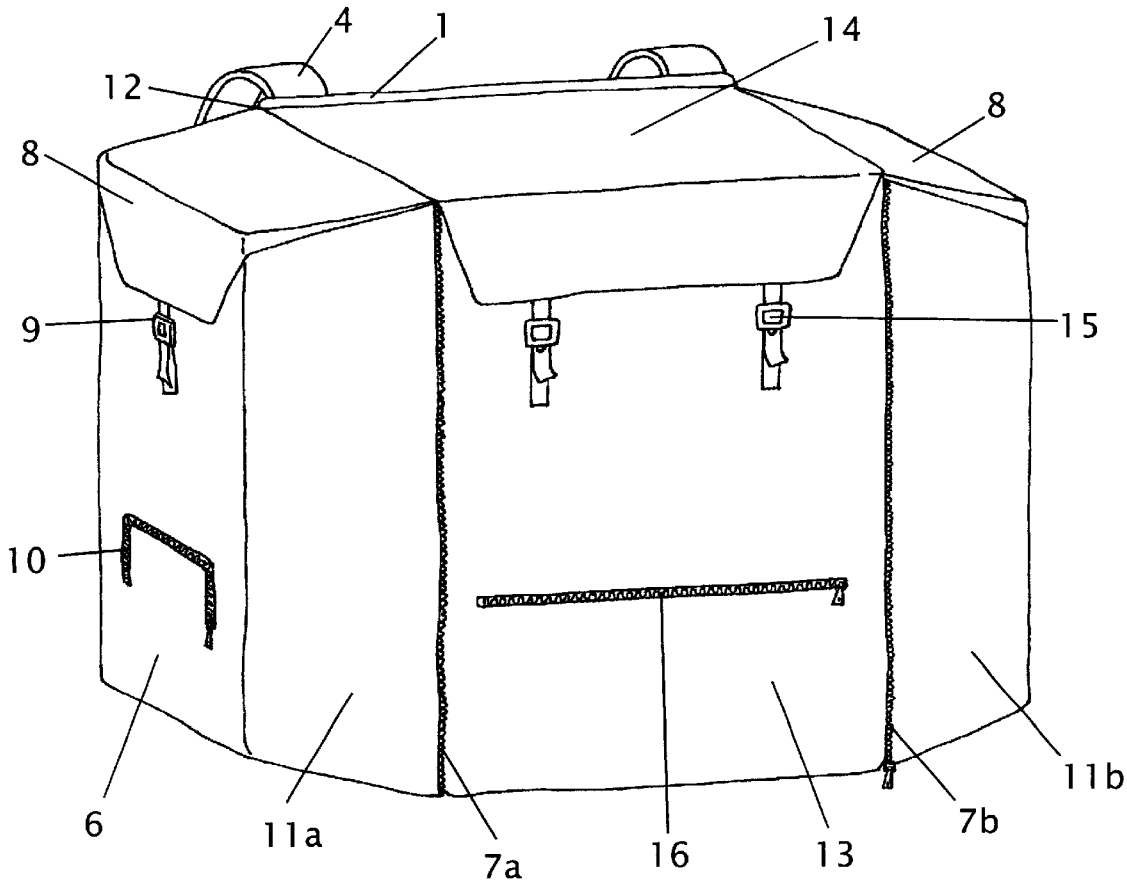
FIG. 2 is an elevated left front quartering view of the invention, showing it in its expanded form.

In accordance with the present invention, a backpack is provided, which is similar in styling to other backpacks designed for outdoor use, which is durable, and which has both compacted and expanded forms. In its primary, compacted form, as shown in FIG. 1, it is similar in size and proportion to what is commonly called a daypack. In its secondary, expanded form, as shown in FIG. 2, it has greater volumetric storage capacity, and can be used for hauling greater loads. In particular, the backpack of the present invention includes a main panel 1, with two adjoining compartments 6 comprised of front, back, and side panels which define separate enclosed storage compartments, a mechanism 7 whereby these storage compartments can be releasably attached to one another, thereby retaining the pack in its primary, compacted form, and when released permitting the aforesaid storage compartments to hinge or rotate outwardly, permitting the expansion and use of a collapsible supplemental storage compartment 13. Preferably the backpack is composed mainly of a high strength, lightweight nylon fabric, although any suitable materials may be used. Also in a preferred embodiment, the various storage compartments of the backpack are subdivided internally into several separate cells, each of which can be individually accessed via a zippered or similarly provided aperture.

More specifically, the construction of the backpack is as follows. The main panel 1 separates the various storage compartments from the wearer's back, is generally rectangular in shape, and may be padded where it will be in direct contact with the wearer's back, or may be attached to an external rigid backpack frame of typical or standard construction, as is familiar in the prior art. In either case, two padded shoulder straps 4, adjustable for length, and of a typical fashion that is widely known to the prior art, are attached to the rear 3 of the main panel to facilitate wearing about the shoulders of a user. A hip or waist belt 5, which also is well known to the art, may or may not be alternatively provided. On the outward edges 12 of the front side 2 of the main panel of the backpack, two primary storage compartments 6 are fixedly attached along the vertical length of the outward edge of their back panels, by means of sewing or the like, in a manner that permits them to hinge or rotate about this axis of attachment. These primary storage compartments are made of nylon or like material, with each having panels that are sewn to one another in a standard fashion so as to form an approximately rectangular storage compartment, which is familiar to the art. In the present embodiment, these storage compartments are fitted with a top flap 8 with releasable and adjustable closure 9, and are fitted with a lower aperture with access zipper 10. Any similar contrivances that perform the same functions for access to the interior of the compartments may be used.

These said primary storage compartments are releasably attached to each other along the inward edge of the vertical length of their back panels, and near the rear edges of the inward facing side panels 11*a* and 11*b* of the primary storage compartments 6, thereby creating a vertical dorsal seam 7 in the approximate middle of the front of the backpack. In another embodiment the releasable attachment that forms this seam may be fixedly attached to the front edges of panels 11*a* and 11*b*. In its ideal embodiment, this releasable dorsal seam is constructed of a heavy-duty zipper or the like. When said mechanism is released, the primary storage compartments 6 are permitted to rotate outwardly approximately ninety degrees, such that their rear panels are thereby made to be approximately perpendicular to the main panel 1 of the backpack, and the side panels 11*a* and 11*b* are thence approximately parallel to the main panel 1. As seen in FIG. 2, the releasable closure 7 separates into two sets of components, 7*a* and 7*b*, which remain attached in their previous relationship to primary compartments 6.

Figure 3:
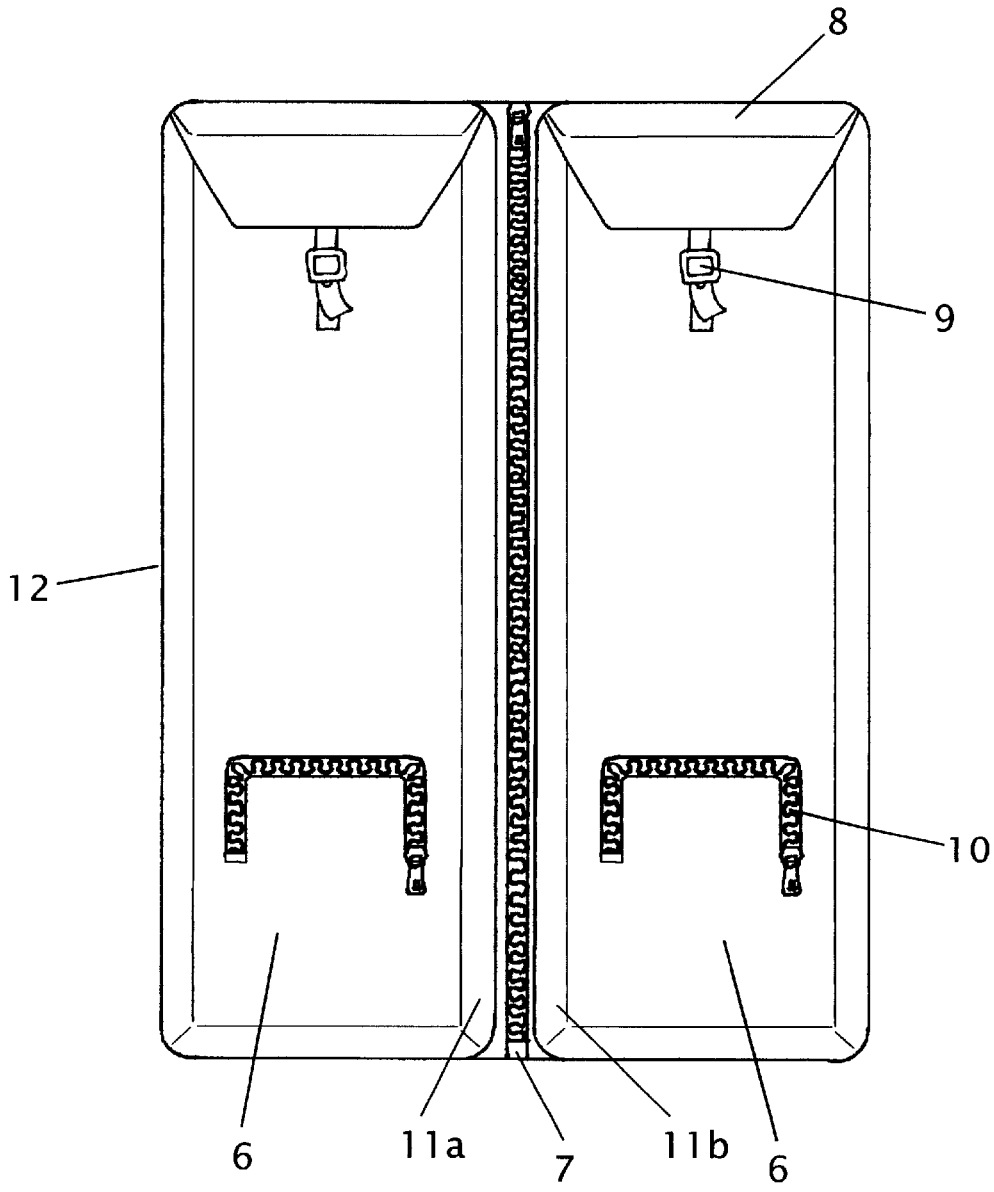
FIG. 3 is a frontal plan view, showing the division between the two primary storage compartments and an example of an embodiment of the releasable mechanism adjoining these.

Additionally, it is necessary that the two primary storage compartments 6 are of approximately equal width as is shown in FIG. 3, such that the uniformity and symmetry of the load is maintained when the backpack is deployed in its expanded form. It can be seen in FIG. 2 that when the backpack is in this form, the primary storage compartments effectively become side compartments in company with a larger storage compartment, and the invention which was previously similar in appearance and proportion to a daypack is now made to be similar in appearance and storage capacity to a larger backpack.

When the said primary storage compartments 6 are in this outwardly rotated position, an additional storage space comprising the majority of the area of the front 2 of the said main panel of the backpack, and containing a collapsible supplemental storage compartment 13, is exposed. This supplemental compartment is a larger boxlike structure, made of nylon or similar fabric, and in the present embodiment is fitted with a top flap 14 and releasable adjustable closures 15, as well as an aperture 16 in the lower portion of the front panel which is fitted with a zipper or the like. In an alternative embodiment, the front panel of this supplemental compartment is made of perforated netting in order to provide ventilation and drainage for fresh meat. In any case, in an ideal embodiment this supplemental compartment is fixedly attached near to outer edges 12 of the main panel of the backpack, and is also attached to the inner edge of the back panel of the primary storage compartments just inward of the line of attachment of the releasable mechanism, thereby forming a construction that functions as a single structural entity. This construction further maintains the integrity and unity of the backpack, such that when it is in its expanded form the rear panels of the primary storage compartments reinforce and support, and are linked to, the left and right sidewalls of the supplemental storage compartment. In an alternative embodiment, this supplemental compartment may be releasably attached to these same approximate locations, without substantially altering the scope of the invention.

The drawings and the present description of the invention are illustrative only, for purposes of explaining and disclosing the invention. Since numerous modifications and changes will readily occur to those skilled in the art, it is not desired to limit the invention to the exact construction shown and described, and accordingly all modifications and equivalents may be regarded as falling within the scope of the invention. Other forms that employ the present invention and serve the purposes described herein are meant to be encompassed by this disclosure.

I claim:

1. A backpack comprising, in combination:

a main panel, generally rectangular in shape, having a top, a bottom, two side edges, a front side, and a rear side;

a pair of primary storage compartments, each having a front panel, a rear panel, two side panels, a top panel, and a bottom panel, with these panels being fixedly attached to one another such that they form a storage compartment with an interior space, and having apertures formed in or near the top for allowing access to said compartment, and each storage compartment being fixedly attached near to the outward edge of the front of said main panel of the backpack, and each storage compartment being releasably attached to the inward side of the other storage compartment;

a releasable closure extending vertically along the central dorsal length of said backpack, adjoining and releasably connecting the two said primary storage compartments such that when said releasable closure is closed these primary storage compartments are held fast, each to the other, having their back panels positioned in an approximately parallel orientation to said main panel of the backpack, and such that when said releasable closure is opened, said primary storage compartments are able to hinge and rotate about the axis of their line of attachment to the backpack such that their back panels are thence approximately perpendicular to said main panel of the backpack, and a supplemental storage area is exposed;

a pair of shoulder straps fixedly attached to said backpack proximal top rear side of said main panel, with the other end being fixedly attached proximal bottom rear side of said main panel, to allow said backpack to be carried on the back of a wearer.

2. The backpack of claim 1 wherein said releasable closure extends vertically one hundred percent of the length of said primary storage compartments, or otherwise selectively permits the complete separation of their junction.

3. The backpack of claim 1 wherein said primary storage compartments are of approximately equal dimension in width.

4. The backpack of claim 3 wherein said primary storage compartments are rotationally re-positioned to effectively form side compartments when the backpack is deployed in its expanded form.

5. The backpack of claim 3 wherein said primary storage compartments are rotationally re-positioned to expose a space encompassing the majority of the front side of said main panel of said backpack, this space being made available for additional storage.

6. The backpack of claim 1 wherein said primary storage compartments have a range of rotational re-positioning in any configuration from between thirty degrees of travel to one hundred eighty degrees of travel from their original position, which is considered to be approximately parallel to the main panel of the backpack.

7. The backpack of claim 1 further including a collapsible supplemental storage compartment which is exposed when said releasable closure is unfastened and the primary storage compartments are repositioned to their outwardly rotated position, this storage compartment being made of nylon or like fabric, and having a front panel, a back panel, two side panels, a top panel, and a bottom panel, with said panels being fixedly attached to one another such that they form a storage container of an approximately rectangular cubic form, and with this storage compartment having an aperture formed in or near the top to permit access.

8. The backpack of claim 7 wherein the described supplemental storage compartment is generally constructed of nylon fabric or like material, but which has at least one portion of one panel which is constructed of ventilated nylon mesh, or netting, or like material, such that said storage compartment is suitable for the transportation of fresh meat.

9. The backpack of claim 1 wherein all said storage compartments may be further internally subdivided into various and separate cells, each with its separate access aperture and selectively releasable mechanism for closure.

* * * * *